US010750830B1

(12) United States Patent
Blekherman

(10) Patent No.: US 10,750,830 B1
(45) Date of Patent: Aug. 25, 2020

(54) DEVICE AND METHOD FOR AXIAL FIXATION OF ELEMENTS

(71) Applicant: Yevgeniy Blekherman, Brooklyn, NY (US)

(72) Inventor: Yevgeniy Blekherman, Brooklyn, NY (US)

( * ) Notice: Subject to any disclaimer, the term of this patent is extended or adjusted under 35 U.S.C. 154(b) by 65 days.

(21) Appl. No.: 16/021,750

(22) Filed: Jun. 28, 2018

Related U.S. Application Data

(60) Provisional application No. 62/528,300, filed on Jul. 3, 2017.

(51) Int. Cl.
*A44B 13/00* (2006.01)
*G10G 5/00* (2006.01)

(52) U.S. Cl.
CPC ..... *A44B 13/0058* (2013.01); *A44D 2211/00* (2013.01); *G10G 5/005* (2013.01)

(58) Field of Classification Search
CPC . A44B 13/0058; A44D 2211/00; G10G 5/005
See application file for complete search history.

(56) References Cited

U.S. PATENT DOCUMENTS

RE23,624 E * 2/1953 Sutin ..... A44B 1/34 24/114.4
3,623,192 A * 11/1971 Papazian ..... A44B 1/28 24/114.4
3,946,466 A * 3/1976 Sakai ..... A42B 3/166 24/568
4,583,780 A * 4/1986 Finn ..... A47D 15/00 24/332
5,168,735 A * 12/1992 Wang ..... A44B 15/00 206/37.5
7,234,210 B2 * 6/2007 Stiles ..... A41D 13/0512 2/411
8,402,618 B2 * 3/2013 Veldhoen ..... F16B 5/0692 24/684
9,675,142 B1 * 6/2017 Hendricks ..... B63B 17/02
2008/0216735 A1 * 9/2008 Boyd ..... B63B 17/02 114/361
2015/0265006 A1 * 9/2015 Weller ..... A41F 1/02 24/388

* cited by examiner

*Primary Examiner* — Robert Sandy
*Assistant Examiner* — David M Upchurch
(74) *Attorney, Agent, or Firm* — Lawrence G. Fridman, Esq; Feigin & Fridman, LLC

(57) ABSTRACT

An assembly for axial fixation of at least one element having an opening formed therein to an article. The assembly includes an anchoring protrusion attached to the article, which includes a distal end and a neck portion, and at least one locking component having a bore disposed therein, the locking component having at least a portion which is at least one of flexible and elastic. The anchoring protrusion extends through the opening in the element and through the bore of the locking component. An overlap region between the opening of the element and the bore of the locking component, is substantially equal to the diameter of the neck portion, such that the element and the at least a portion of the locking component form a locking unit.

9 Claims, 11 Drawing Sheets

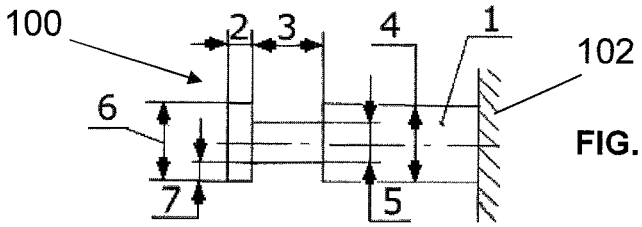
FIG. 1
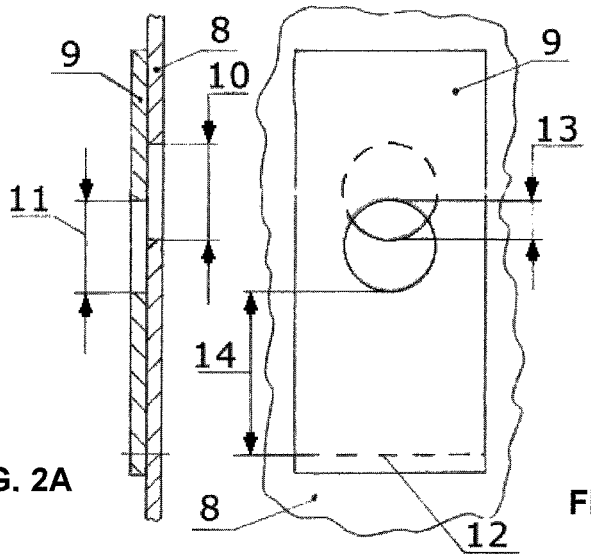
FIG. 2A
FIG. 2B
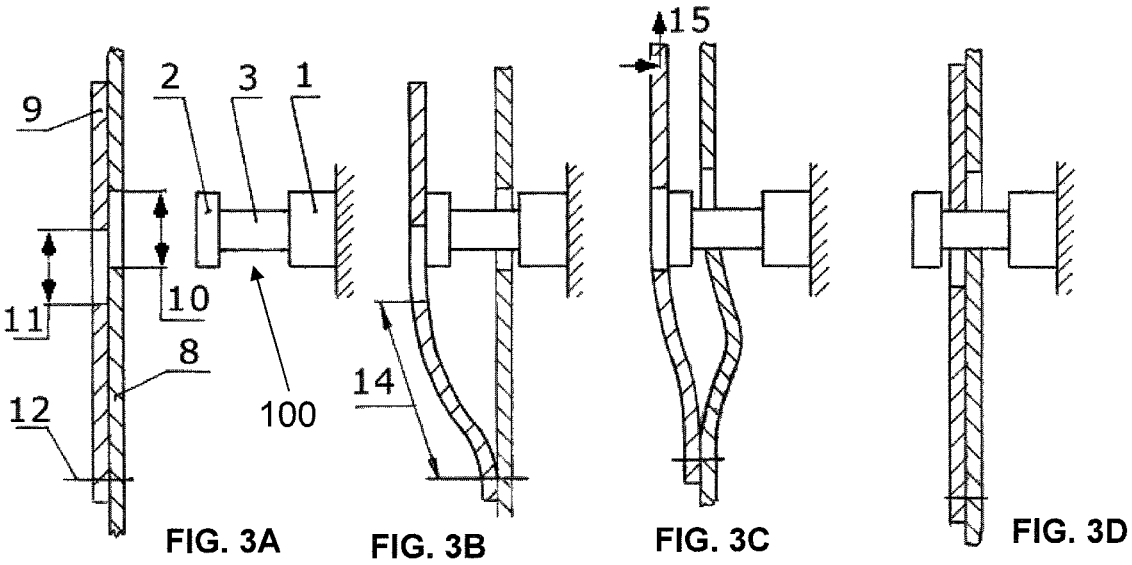
FIG. 3A
FIG. 3B
FIG. 3C
FIG. 3D

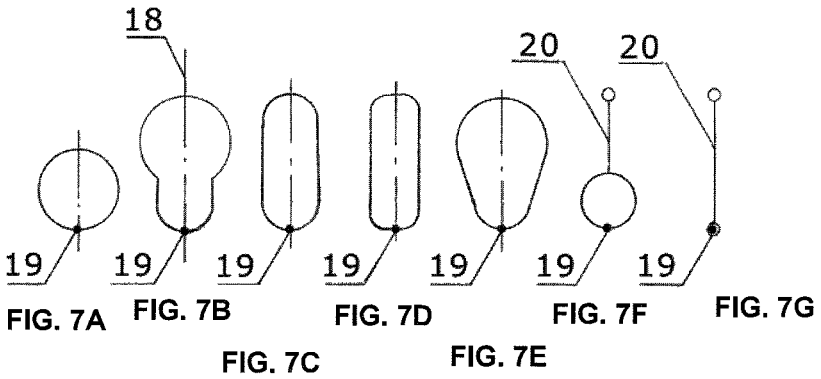
18
20
20
19
19
19
19
19
19
19
FIG. 7A
FIG. 7B
FIG. 7C
FIG. 7D
FIG. 7E
FIG. 7F
FIG. 7G
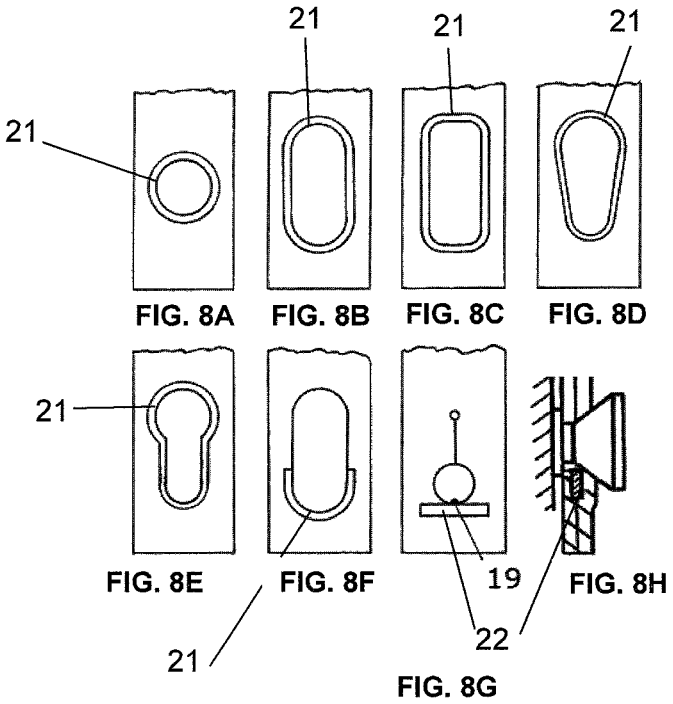
21
21
21
21
FIG. 8A
FIG. 8B
FIG. 8C
FIG. 8D
21
FIG. 8E
FIG. 8F
19
FIG. 8H
21
22
FIG. 8G

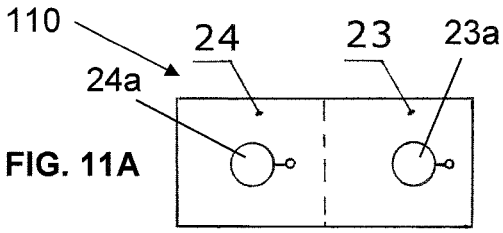
FIG. 11A
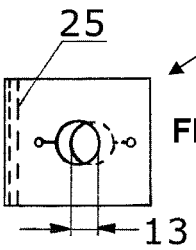
FIG. 11B
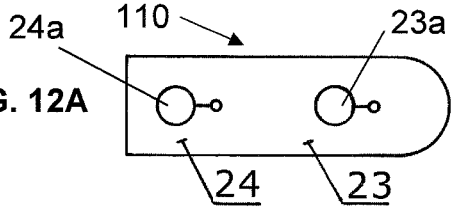
FIG. 12A
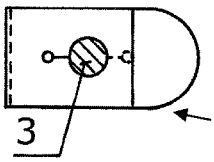
FIG. 12B
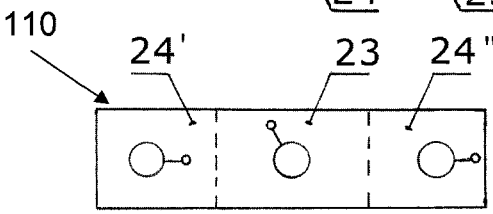
FIG. 13A
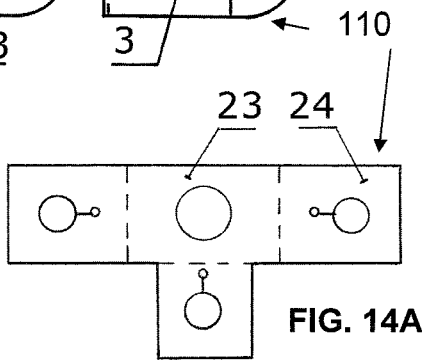
FIG. 14A
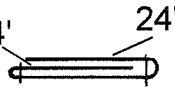
FIG. 13B
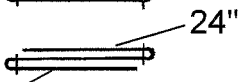
FIG. 13C
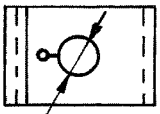
FIG. 13D
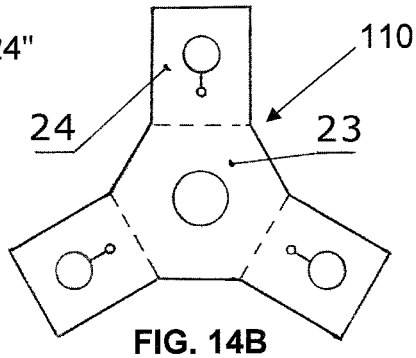
FIG. 14B
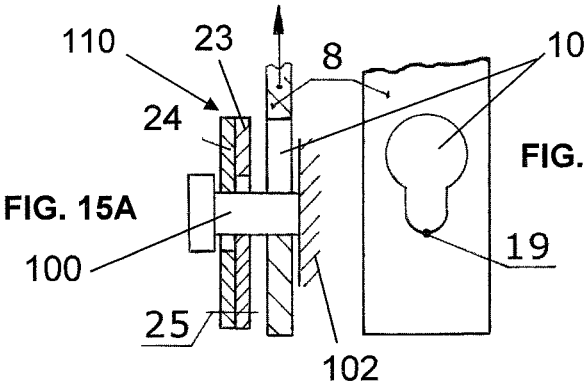
FIG. 15A
FIG. 15B

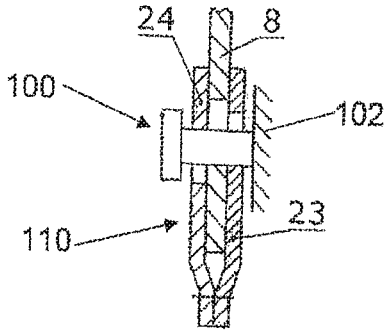
FIG. 16
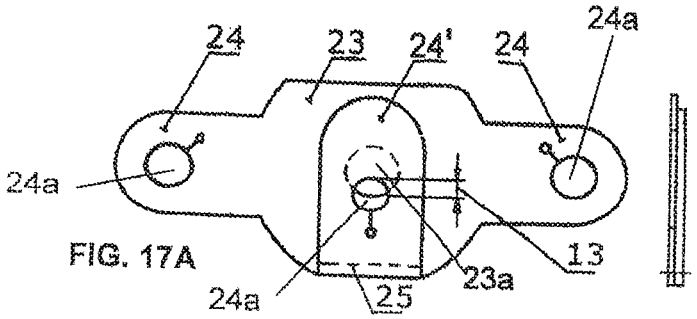
FIG. 17A
FIG. 17B
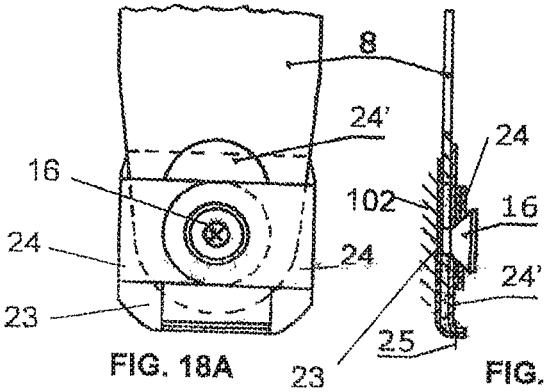
FIG. 18A
FIG. 18B

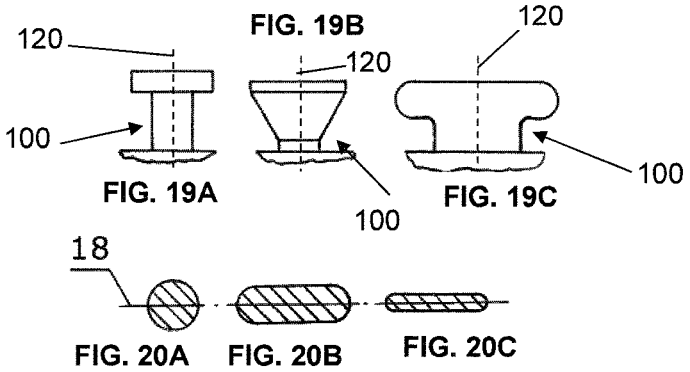
120
100
FIG. 19A
FIG. 19B
120
100
120
100
FIG. 19C
18
FIG. 20A
FIG. 20B
FIG. 20C
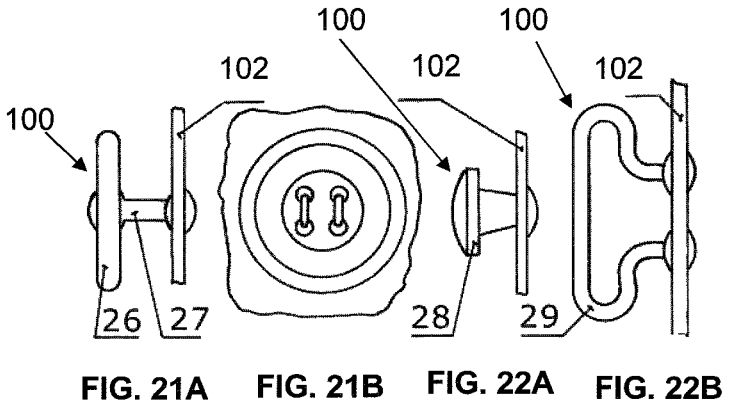
100
102
26
27
FIG. 21A
100
102
FIG. 21B
100
102
28
FIG. 22A
29
FIG. 22B

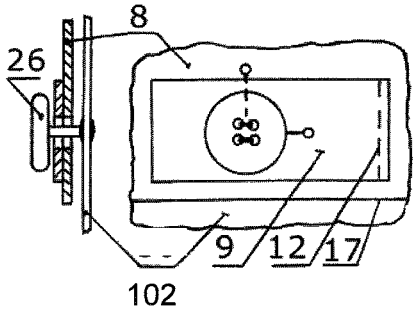
FIG. 23A
FIG. 23B
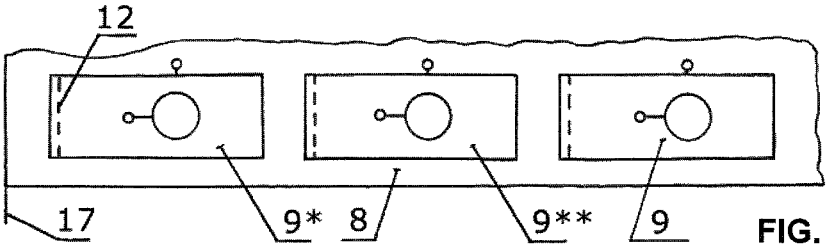
FIG. 23C
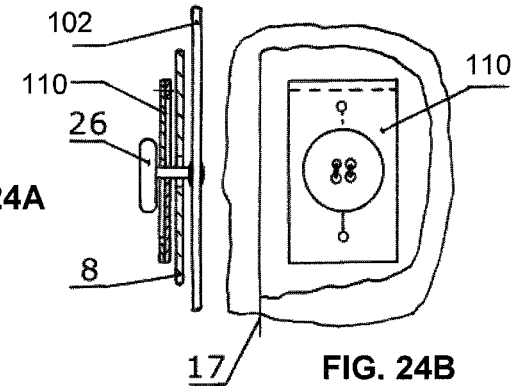
FIG. 24A
FIG. 24B

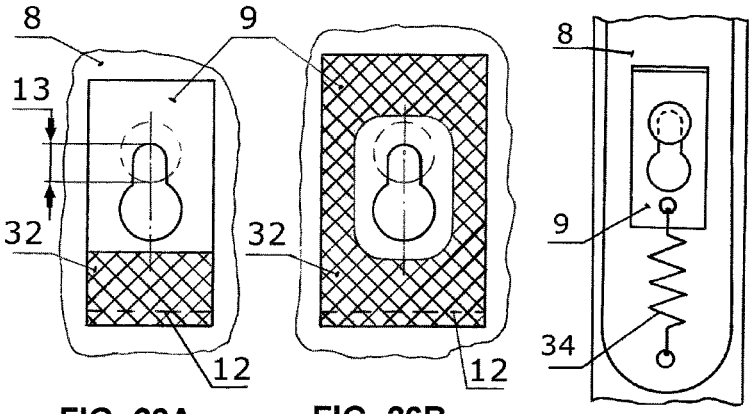
FIG. 26A FIG. 26B FIG. 26C
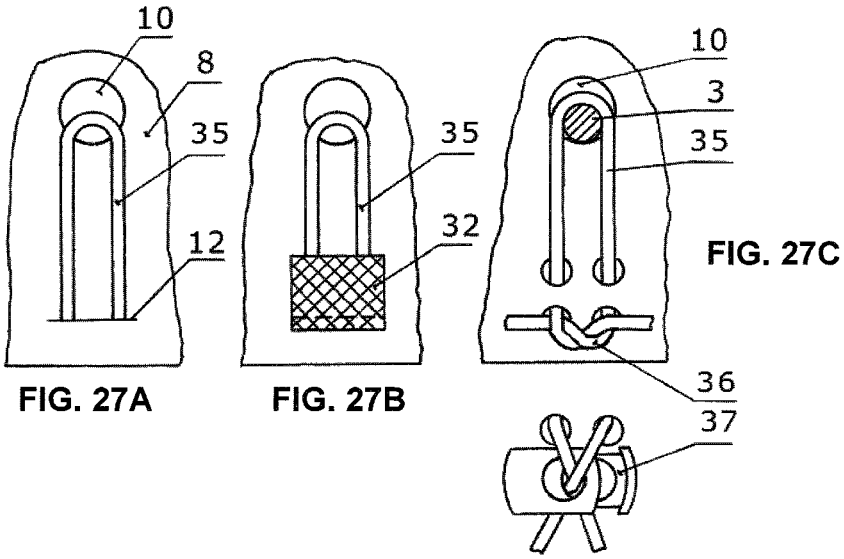
FIG. 27A FIG. 27B FIG. 27C
FIG. 27D

DEVICE AND METHOD FOR AXIAL FIXATION OF ELEMENTS

CROSS-REFERENCE TO RELATED APPLICATION

The present application claims priority of Provisional Patent Application Ser. No. 62/528,300 filed by the Applicant on Jul. 3, 2017, the entire disclosure of which is hereby incorporated by reference.

FIELD AND BACKGROUND OF THE DISCLOSED TECHNOLOGY

The present invention relates to an assembly and a method for releasably and/or reversibly fastening an element to a connecting link associated with an article.

In the prior art, there are known examples of devices provided for connecting various elements to one another. For example, devices for fastening a guitar belt to a button provided on the guitar body by using a strap lock are known in the art. Fastening an awning on a truck is also known.

Furthermore, fastening arrangements known in the prior art are adapted for a limited ratio between the diameter at the end of the shaft of the arrangement and the diameter of the anchoring protrusion in which the arrangement is disposed—the prior art ratio is approximately 1:4 and is determined only by the size of the button or the connecting link.

However, there remains a need in the art for a device and method for detachable connection and simultaneous axial fixation of an element to an article, which need the present invention fulfills.

SUMMARY OF THE DISCLOSED TECHNOLOGY

The disclosed technology relates generally to an assembly and a method for releasably and/or reversibly fastening an element to a connecting link or anchoring protrusion associated with an article.

The element is typically formed of a thin, elastic, and/or flexible material, such as fabric, leather, plastics, synthetics, composite materials, and the like. The connecting link can be located on any suitable article, such as a musical instrument, luggage, truck, platform, or the like. The device of the invention, provides axial fixation of the element to the article, while at the same time also acts as a lock on the connecting link.

In some embodiments the assembly may include a multi-layer washer, which differs in design, thickness, installation method, principle of operation, and simplicity of manufacture from devices of the prior art. Additionally, in the multi-layer washer of the invention, the ratio of the respective diameters and the magnitude of the diameters themselves are not limited, unlike the prior art devices described in the Background section above. For example, using the present invention, a large button and threads may be attached to an article using a thickness of a fraction of a millimeter.

As described in further detail hereinbelow, the anchoring protrusion of the present invention includes a distal end, and the element is provided with an opening. Through the opening, the element is mounted onto the distal end of the anchoring protrusion.

A locking component may be made of a thin material and is formed with a bore, which only partially overlaps the opening in the element.

The locking component is fixed in such a way that a part of the opening in the element and the bore in the locking component, partially overlap each other. The overlap region is approximately equal to a diameter of the neck portion of the anchoring protrusion. The element and locking component are arranged such that the element can deform longitudinally by an amount approximately equal to the depth of the neck of the anchoring protrusion, facilitating insertion of the anchoring protrusion into the opening.

In the method of the invention, the locking component may be pulled by an operator, and as a result the element is deformed so as to insert the anchoring protrusion into the opening. The bore in the locking component is then brought to the distal end of the anchoring element, and the anchoring element is pushed in so the bore surrounds the neck portion of the anchoring element. The locking element is then released. Due to fixing between the locking component and the element, a locking unit is formed.

There are multiple applications of the invention in various fields of technology. For example, the invention can be used in general for releasably fastening a belt to a button. More specifically, it can be used as a connecting link for musical instruments (for example, a guitar). The invention can be also used for fastening curtains, awnings on trucks, platforms, in tourist and mountaineering equipment, etc. Furthermore, the method and the elements of the invention can be used as a "lock" on the connecting link.

According to an embodiment of the teachings herein, there is provided a method of axial fixation of at least one element to an article via an anchoring protrusion attached to the article, the anchoring protrusion including a distal end distal to the article, the method including:

passing at least a portion of the anchoring protrusion via an opening in the at least one element; and inserting at least a portion of the anchoring protrusion via a bore in at least one locking component, such that at least a portion of the locking component is disposed between the at least one element and a surface of the distal end of the anchoring protrusion, wherein at least a portion of the locking component is at least one of flexible and elastic, wherein an overlap region between the opening of the at least one element and the bore of the locking component, is substantially equal to a diameter of a neck portion of the anchoring protrusion, and wherein, following the inserting, the element and the at least a portion of the locking component form a locking unit.

In some embodiments, the method further includes, prior to the passing, using a solid material, reinforcing at least a portion of a perimeter of the opening in the element.

In some embodiments, the method further includes, prior to the passing, fixedly attaching the locking component to the element.

In some embodiments, the element and the locking component are integrally formed from a single piece of material.

In some embodiments, the locking component includes a multi-layer washer separate and independent from the element, and the multi-layer washer includes a central portion including a first bore at least one extension lobe including at least one second bore, wherein the inserting includes:

initially inserting the at least a portion of the anchoring protrusion into the first bore in the central portion; and subsequently, inserting the at least a portion of the anchoring protrusion into the at least one second bore in the at least one extension lobe.

In some embodiments, the initially inserting takes place prior to the passing, and the subsequently inserting takes place following the passing.

In some embodiments, the method further includes, following the subsequently inserting, and while the anchoring protrusion extends through the first bore and the at least one second bore, fastening the central portion to the at least one extension lobe.

In some embodiments, the method further includes, prior to the passing, attaching the anchoring protrusion to the article.

In some embodiments, the attaching includes attaching the distal end to the article using an attachment mechanism, the attachment mechanism forming a neck portion separating the distal end from the article.

In some embodiments, the method further includes following the inserting while the anchoring protrusion extends through the opening of the element and the bore of the locking component, fastening the element to the locking component.

In some embodiments, the locking component includes at least one elastic or spring-based portion, and wherein the inserting includes stretching the at least one elastic or spring-based portion to extend around the at least a portion of the anchoring protrusion.

According to another embodiment of the teachings herein, there is provided an assembly for axial fixation of at least one element having an opening formed therein to an article, the assembly including:

an anchoring protrusion attached to the article, the anchoring protrusion including a distal end distal to the article and a neck portion disposed between the article and the distal end, the neck portion having a first diameter and the distal end having a second diameter, the second diameter being greater than the first diameter;

at least one locking component having a bore disposed therein, the locking component having at least a portion which is at least one of flexible and elastic, wherein the anchoring protrusion extends through the opening in the element and through at least one the bore of the at least one locking component, such that the opening and the at least one the bore are disposed about the neck portion of the anchoring protrusion, wherein at least a portion of the locking component is disposed between the at least one element and a surface of the distal end of the anchoring protrusion, and wherein an overlap region between the opening of the at least one element and the at least one bore of the at least one locking component, is substantially equal to the first diameter, such that the element and the at least a portion of the locking component form a locking unit.

In some embodiments, the at least one element includes a solid material, reinforcing at least a portion of a perimeter of the opening in the element.

In some embodiments, the at least one locking component is fixedly attached to the element.

In some embodiments, the element and the locking component are integrally formed from a single piece of material.

In some embodiments, the locking component includes a multi-layer washer separate and independent from the element, the multi-layer washer including:

a central portion including a first bore; and at least one extension lobe including at least one second bore, wherein the anchoring protrusion extends through the first bore of the central portion and through the at least one second bore in the at least one extension lobe, such that along a longitudinal axis of the anchoring protrusion, the central portion is disposed closer to the article than the at least one extension lobe.

In some embodiments, the central portion is disposed between the article and the element, the element is disposed between the central portion and the at least one extension lobe, and the at least one lobe is disposed between the element and the distal end of the anchoring protrusion.

In some embodiments, the anchoring protrusion includes a device forming the distal end, and the neck portion includes an attachment mechanism connecting the device to the article.

In some embodiments, the distal end and the neck portion of the anchoring protrusion are integrally formed.

In some embodiments, the locking component includes at least one elastic or spring-based portion which extends around at least a portion of the anchoring protrusion.

BRIEF DESCRIPTION OF THE DRAWINGS

FIG. 1 is a schematic side view illustration of an anchoring protrusion of a device according to an embodiment of the present invention.

FIGS. 2A and 2B are, respectively, a sectional illustration and a top view illustration of an element including an opening for receiving the anchoring protrusion of FIG. 1.

FIGS. 3A, 3B, 3C, and 3D are schematic sectional illustrations of the process of inserting the anchoring protrusion of FIG. 1 into the opening of FIGS. 2A and 2B.

FIGS. 7A to 7G are top view planar illustrations of various embodiments of openings in the element suitable for receiving a shaft according to the present invention.

FIGS. 8A to 8G are top view planar illustrations of strengthening the openings 10 of FIGS. 7A to 7G.

FIG. 8H is a sectional view illustration of a system using the strengthened opening of FIG. 8G FIGS. 9A, 9B, 9C, and 9D are schematic top view illustrations of the opening 10 of FIG. 7F arrangement in an element according to an embodiment of the invention.

FIGS. 11A and 11B illustrate a first embodiment of a multi-layer washer usable as a locking component in accordance with the present invention, where FIG. 11A is a top view illustration of the multi-layer washer when spread out, and FIG. 11B is a top view illustration of the multi-layer washer ready to be used.

FIGS. 12A and 12B illustrate a second embodiment of a multi-layer washer usable as a locking component in accordance with the present invention, where FIG. 12A is a top view illustration of the multi-layer washer when spread out, and FIG. 12B is a top view illustration of the multi-layer washer ready to be used.

FIGS. 13A, 13B, 13C, and 13D illustrate a third embodiment of a multi-layer washer usable as a locking component in accordance with the present invention, where FIG. 13A is a top view illustration of the multi-layer washer when spread out, FIGS. 13B and 13C are side view illustrations and FIG. 13D is a top view illustration of the multi-layer washer ready to be used.

FIGS. 14A and 14B are top view planar illustrations of a fourth embodiment and a fifth embodiment of a multi-layer washer usable as a locking component in accordance with the present invention, when spread out.

FIGS. 15A and 15B are, respectively, a sectional illustration of a multi-layer washer installed onto an anchoring protrusion according to an embodiment of the present invention and a top view illustration of an element which the multi-layer washer locks into place.

FIG. 16 is a sectional illustration of an element and a multi-layer washer installed onto an anchoring protrusion according to another embodiment of the present invention.

FIGS. 17A and 17B are, respectively, a top view planar illustration and a side view illustration of a multi-layer washer suitable for use with a guitar strap according to an embodiment of the present invention.

FIGS. 18A and 18B are, respectively, a top view planar illustration and a sectional illustration of the multi-layer washer of FIGS. 17A and 17B and a guitar belt mounted onto an anchoring protrusion according to an embodiment of the present invention.

FIGS. 19A, 19B, and 19C are side view planar illustrations of various embodiments of an anchoring protrusion in accordance with the present invention.

FIGS. 20A, 20B, and 20C are cross sectional illustrations of the anchoring protrusions of FIGS. 19A, 19B, and 19C, respectively, the cross-sectional illustrations taken in a direction perpendicular to a longitudinal axis of the anchoring protrusion.

FIGS. 21A and 21B are, respectively, side view and top view planar illustrations of an anchoring protrusion according to the present invention including a multi-part button.

FIGS. 22A and 22B are side view planar illustrations of embodiments of anchoring protrusions according to the present invention including buttons formed of a single unit.

FIGS. 23A and 23B are, respectively, a sectional illustration and a top view planar illustration of a system for detachably locking an element to an article according to an embodiment of the present invention.

FIG. 23C is a top view planar illustration of the system of FIGS. 23A and 23B, including a plurality of locking components.

FIGS. 24A and 24B are, respectively, a sectional illustration and a top view planar illustration of a system for detachably locking an element to an article using a multi-layer washer according to an embodiment of the present invention.

FIGS. 26A, 26B, and 26C illustrate a system according to the present invention in which the locking component comprises an elastic element or a spring-based element.

FIGS. 27A, 27B, 27C, and 27D illustrate a system according to the present invention in which the locking component comprises a rope.

DETAILED DESCRIPTION OF EMBODIMENTS OF THE DISCLOSED TECHNOLOGY

Figure 4A:
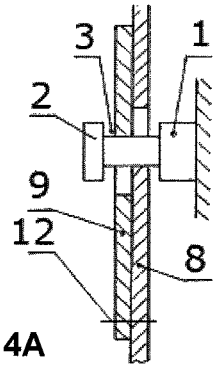
FIGS. 4A, 4B, and 4C are schematic sectional illustrations of various embodiments for the formation of the anchoring protrusion of FIG. 1.

In an embodiment of the disclosed technology, a clamp or connecting link associated with an article is removably and releasably seated within an opening in a flat flexible element, thereby connecting the element to the article while providing for axial fixation of the element and the article at the joint.

Embodiments of the disclosed technology will become clearer in view of the following description of the drawings.

In the context of the present application, the terms 'substantially equal', 'substantially identical', and 'substantially the same' relate to two items or dimensions having a difference of at most 10% therebetween, or being 'at least 90% equal', 'at least 90% identical' or 'at least 90% the same', unless otherwise indicated.

Reference is now made to FIG. 1, which is a schematic side view illustration of an anchoring protrusion of the device of the present invention.

As seen in FIG. 1, an anchoring protrusion 100 according to an embodiment of the invention, also termed a connecting link herein, is mounted onto or otherwise connected to or associated with a surface 102 of an article to which a flexible element will be connected.

The anchoring protrusion 100 includes a shaft 1 having an end portion 2 distal to surface 102. A neck portion 3 connects shaft 1 and distal end 2. The shaft 1 has a first diameter indicated by reference numeral 4, and the distal end 2 has a second diameter indicated by reference numeral 6. In some embodiments, first diameter 4 is equal to second diameter 6. The neck portion 3 has a third diameter 5, which is smaller than first diameter 4 and second diameter 6, as indicated by reference numeral 7 which illustrates the depth of the neck portion 3 relative to the distal end 2.

Turning now to FIGS. 2A and 2B, which are, respectively, a sectional illustration and a top view illustration of an element including an opening for receiving the anchoring protrusion 100 of FIG. 1, it is seen that an element 8 to be connected to the article 102 includes an opening 10. It is appreciated that though in the illustrated embodiment, the opening 10 is shown as a circular opening, any suitable opening shape is considered within the scope of the present invention.

A locking component 9, which, in some embodiments, is made of a thin flexible material, includes a bore 11, here illustrated as a circular bore. Locking component 9 is attached to the element 8 such that bore 11 is not aligned with opening 10, as shown clearly in FIG. 2A. As seen in FIG. 2B, opening 10 and bore 11 overlap in a region 13, which, in some embodiments, has a cross section approximately equal to third diameter 5 of neck portion 3 of anchoring protrusion 100, so as to facilitate placement of the neck portion 3 within opening 10 and bore 11 without any substantial stretching or deforming of the element 8 and the locking component 9.

In some embodiments, the attachment between locking component 9 and element 8 is provided only along a portion of the locking component 9, illustrated as region 12 in FIG. 2B, which is spaced from the end of bore 11 by a distance 14. This arrangement enables the element 8 and/or the locking component 9 to be deformed so as to align the opening 10 with bore 11 for insertion of distal end 2 of anchoring protrusion 100 thereinto, as explained in further detail hereinbelow.

In some embodiments, the shape of bore 11 is similar to that of opening 10—in the illustrated embodiment bore 11 is circular like opening 10. However, in other embodiments, bore 11 and opening 10 may have different shapes, or different dimensions, as suitable.

In some embodiments, the diameters or cross sections of opening 10 and bore 11 are approximately equal to the second diameter 6 of distal end 2 of anchoring protrusion 100 or are greater than the second diameter so as to facilitate passing of the distal end 2 of anchoring protrusion 100 through the opening 10 and the bore 11 as described hereinbelow.

Reference is now made to FIGS. 3A, 3B, 3C, and 3D, which are schematic sectional illustrations of the process of inserting the anchoring protrusion of FIG. 1 into the opening of FIGS. 2A and 2B.

As seen by comparison of FIGS. 3A and 3B, in an initial use step, distal end 2 of anchoring protrusion 100 is inserted into opening 10 of element 8, such that neck portion 3 is surrounded by the perimeter of the opening 10.

Subsequently, the locking component 9 is manipulated in the direction indicated by arrow 15 and the element 8 is elastically and reversibly deformed in the longitudinal direction thereof so that bore 11 thereof is aligned with distal end 2 of anchoring protrusion 100, as seen in FIG. 3C. The degree of deformation of element 8 is approximately equal to the depth 7 of the neck portion 3.

As seen in FIG. 3D, the distal end 2 is passed through the bore 11 such that bore 11 is disposed about neck portion 3. Due to the flexibility and/or elasticity of element 8, when the element 8 and locking component 9 are released, they return to the initial flat and parallel relative position. As seen in FIG. 3D, due to the misalignment between opening 10 and bore 11, when locking component 9 returns to its resting position the neck portion 3 engages the perimeter of opening 10 at one side thereof, and the perimeter of bore 11 at the opposing side. As such, neck portion 3 is fixed between element 8 and locking component 9, and element 8 is fixed to the article by means of the locking component 9 and the anchoring protrusion 100.

For the greater reliability of the fixation of the element 8 around anchoring protrusion 100, it is possible to reduce the dimensions of gap 13 opening 10 and bore 11 (opening 10 and bore 11 have a smaller area of overlap). However, the increased pre-tension present by such a modification of gap 13, may increase the wear of the material in the opening 10 and/or bore 11, and/or may damage and/or soften the material of element 8 and/or locking component 9 during intensive or repeated use. This problem may be alleviated by reinforcing the perimeter of opening 10 and/or of bore 11, for example as described hereinbelow with respect to FIGS. 8A to 8H.

Figure 4B:
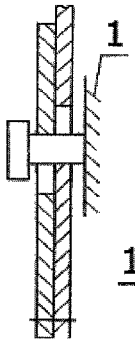
Figure 4C:
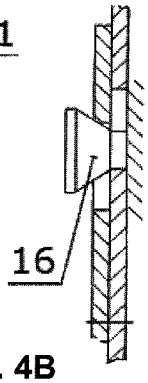

Reference is now made to FIGS. 4A, 4B, and 4C, which are schematic sectional illustrations of various embodiments for the formation of the anchoring protrusion 100 of FIG. 1.

As seen in FIG. 4A, the neck portion 3 of anchoring protrusion 100 is disposed within opening 10 of element 8 and bore 11 of locking component 9. As seen in FIG. 4B, in some embodiments, the anchoring protrusion 100 does not include a shaft portion 1, but rather only includes a neck portion 3 and a distal end 2. In such embodiments, the neck portion 3 is directly connected to the article 102. In such embodiments, the required axial fixation of the element 8 is achieved by appropriately sizing the neck portion 3. In some such embodiments, the thickness of the element 8 and locking component 9 may also be adapted to ensure proper fixation, and/or a conical profile of neck portion 3 may be used, as illustrated in FIG. 4C. Specifically, FIG. 4C shows neck portion 3 disposed within opening 10 of element 8, extending in a conical section 16 to distal end 2, where the conical section 16 is disposed within bore 11 of reinforcement element 9.

Figure 5A:
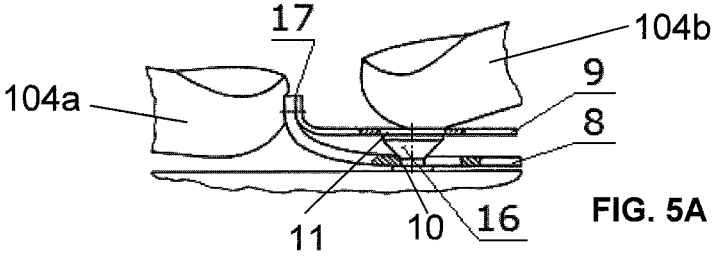
FIGS. 5A, 5B, 5C, and 5D illustrate steps of a process for connecting an end of a guitar strap element to an anchoring protrusion formed on a guitar, according to an embodiment of the teachings herein.
Figure 5B:
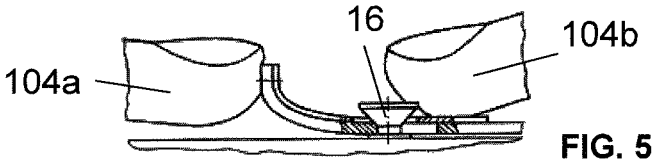

Turning now to FIGS. 5A, 5B, 5C, and 5D, these Figures illustrate steps of a process for connecting an end part 8 of a guitar belt to an anchoring protrusion (equivalent to anchoring protrusion 100 of FIG. 1) formed as a button or connector 16 on a guitar 102, according to an embodiment of the teachings herein. As seen in FIG. 5A, and as described hereinabove with respect to FIGS. 3A to 3D, the button 16 is inserted through opening 10 in end part 8 of the guitar belt. During insertion of the button 16 into opening 10, the user's finger 104*a* causes an edge 17, equivalent to attachment region 12 described hereinabove, to deform, for example away from the body of the guitar, as illustrated in FIGS. 5A and 5B. Following alignment of bore 11 of locking component 9 with button 16, another finger 104*b* of the user pushes the locking component 9 onto button 16, such that button 16 extends also through bore 11, as illustrated in FIG. 5B. The user may then remove his or her fingers.

Figure 5C:
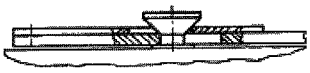
Figure 5D:
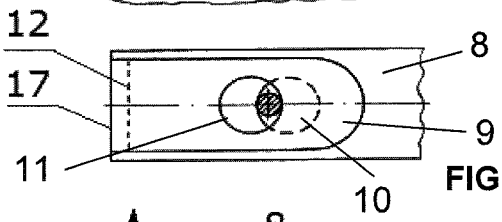

The elasticity of the materials of the end part 8 of the guitar belt and the locking component 9, facilitates straightening of the end part 8 and locking component 9 and the fixation of the belt around the button 16, as seen in FIGS. 5C and 5D.

In the embodiment of FIGS. 5A to 5D, the locking component 9 functions as a strap lock, preventing axial movement of the end 8 of the belt on the guitar button 16. To remove the guitar belt, initially the locking component 9 is detached from button 16. It is appreciated that the attachment method shown in FIGS. 5A to 5D can be used for various other applications, including, for example, attaching a tent to a truck, attaching curtains, attaching tent elements to each other, and/or attaching elements of tourist and mountaineering equipment to a vehicle or to each other.

The element 8 and the locking component 9, which are fixed to each other, form a locking unit as explained hereinabove. It is a particular feature of this connection that the element 8 together with the locking component 9 may be rotated 360 degrees about the neck portion 3 of the anchoring protrusion 100, or about the button 16.

Figure 6A:
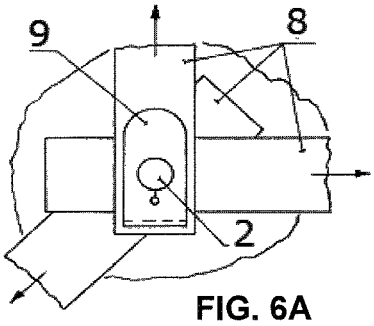
FIGS. 6A and 6B are, respectively, a schematic top view planar illustration and a sectional planar illustration, illustrating the connection of a plurality of elements to a product using the anchoring protrusion of FIG. 1 and the method of FIGS. 5A to 5D.
Figure 6B:
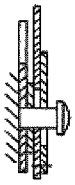

Reference is now made to FIGS. 6A and 6B, which are, respectively, a schematic top view planar illustration and a sectional illustration, illustrating the connection of a plurality of elements 8 to an article 102 using the anchoring protrusion 100 of FIG. 1 and the method of FIGS. 5A to 5D.

As seen in FIGS. 6A and 6B, a plurality of elements 8, each including an opening 10, may be mounted onto the anchoring protrusion 100 by disposing the anchoring protrusion 100 through the openings 10. The various elements 8 may be disposed in different directions, as illustrated in FIG. 6A. The locking component 9 is only attached to one of the elements 8*a*, which is the last element 8 to be positioned onto the anchoring protrusion 100. As such, only that last element 8*a* need have a locking (fixing) link as described hereinbelow.

Reference is now made to FIGS. 7A to 7G, which are top view planar illustrations of various embodiments of openings 10 in the element 8 suitable for receiving an anchoring protrusion 1 according to the present invention.

As seen in FIGS. 7A to 7G, the opening 10 in element 8 may have any of a variety of shapes, and a specific shape for the opening may be selected according to the specific use of the invention and what the anchoring protrusion is designed to fix. As seen in FIGS. 7A to 7E, the openings may be symmetrically disposed about an axis of symmetry 18. Each opening 10 also has an assumed point of engagement 19, which is a point on the perimeter of the opening expected to engage neck portion 3 of the anchoring protrusion 100 (FIG. 1).

In some embodiments, the shape of the opening 10 is selected to ensure ease of positioning the element 8 on and removal of element 8 from the anchoring protrusion 100, button 16, or any other connecting link. In some embodiments, the shape of the opening 10 is selected to increase the reliability of axial fixation of the element, for example taking into consideration the magnitude and direction of forces applied to the element 8. In some embodiments, the shape of the opening 10 is selected to improve the manufacturing process of the element 8. In some embodiments, the shape of the opening 10 is selected to improve the load acceptable by the element 8 in the contact area with the anchoring protrusion 100, button 16, or other connecting link. Of course, any one or more of these reasons may be taken into consideration when selecting the shape of the opening 10.

In some embodiments, in order to increase the reliability of axial fixation of element 8, it is necessary to include most of the material of the element in the contact area with anchoring protrusion 100. This may be accomplished by selecting the size of opening 10 in the element 8 to be commensurate with the diameter of the neck portion 3 of the anchoring protrusion 100. However, the diameter of neck portion 3 is typically smaller than the diameter of distal end 2 of the anchoring protrusion, as described hereinabove with respect to FIG. 1.

Various features may be used in order to insert the anchoring protrusion 100 or other connecting link into an opening 10 having a diameter similar to that of neck portion 3. For example, the opening may be selected to have an elongate shape, as illustrated for example in FIGS. 7C and 7D. As another example, the opening may be selected to include a slot 20 extending through the material of element 8 away from the opening 10, so as to facilitate insertion of distal end 2 into the element, as illustrated in FIG. 7F, or have the opening be formed as a slot 20, as illustrated in FIG. 7G. In these embodiments of FIGS. 7F and 7G, the distal end 2 of anchoring protrusion 100 may be inserted into the opening from a side of the anchoring protrusion.

In some cases of the embodiment of FIG. 7F, the diameter of opening 10 is selected to be equal to the diameter of neck portion 3 (diameter 5 in FIG. 1), such that the opening 10 may be concentric with neck portion 3. However, the fixation quality in this arrangement dependent on the materials from which element 8 and locking component 9 are formed, since there is no fixation due to the misalignment of opening 10 and bore 11. The description of FIGS. 12A to 15B, which relate to a multi-layer washer, demonstrate how concentric fixation may be used in the formation of a locking unit.

Reference is additionally made to FIGS. 8A to 8G, which are top view planar illustrations of strengthening the openings 10 of FIGS. 7A to 7G, and to FIG. 8H which is a sectional view illustration of a system using the strengthened opening of FIG. 8G.

As discussed herein, the opening 10 in element 8 of the present invention receives the majority of the load from the neck portion 3 of anchoring protrusion 100. Therefore, in order to reduce deformation of the opening 10 and to increase the reliability of the connection, the opening 10 may be completely or partially strengthened using a solid material, such as steel eyelets or a wire insert of circular or rectangular cross-section provided under the opening. FIGS. 8A to 8F illustrate the openings of FIGS. 7A to 7F when strengthened using steel eyelets 21. As seen, in FIGS. 8A to 8E the steel eyelets 21 surround the entire perimeter of the opening, and in FIG. 8F the steel eyelets surround only a portion of the perimeter.

FIG. 8G illustrates strengthening of the opening of FIG. 7F using a wire insert 22 adjacent the engagement point 19 of opening 10, and FIG. 8H illustrates the opening of FIG. 8G, in use. As seen in FIG. 8H, when the anchoring protrusion 100 is disposed through opening 10, force applied by the anchoring protrusion is adjacent the reinforcing wire insert 22, thus ensuring that the opening 10 does not become deformed. It will be appreciated that this type of strengthening is particularly useful for guitar belts.

In the openings of the elements illustrated in FIGS. 7B, 7C, 7D, 7E, and 7F, the minimal diameter or cross section of the opening is approximately equal to the diameter of the neck portion of the anchoring protrusion (e.g. diameter 5 of neck portion 3, FIG. 1).

Figure 9A:
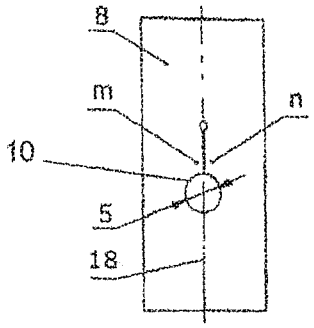
FIG. 9E is a side view planar illustration of the element of FIGS. 9A and 9B, when force is applied thereto.
Figure 9B:
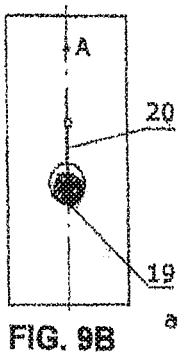
Figure 9E:
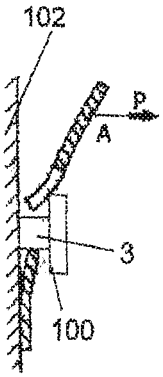

Reference is now additionally made to FIGS. 9A, 9B, 9C, and 9D, which are schematic top view illustrations of the opening 10 of FIG. 7F arrangement in an element 8 according to an embodiment of the invention, and to FIG. 9E which is a side view planar illustration of the element of FIGS. 9A and 9B, when force is applied thereto.

One characteristic of the diameter of the opening being approximately equal to that of the neck portion of the anchoring protrusion, is that the connection with the attaching/connecting link is the weakest and least reliable when load is applied at a point positioned along the axis of symmetry 18 of the opening 10. This is particularly true when the point at which the load is applied is on the side of slot 20, distant from point of contact 19, for example point A illustrated in FIG. 9B. Load is applied onto point A by pulling it away from the article 102, as illustrated by arrow P in FIG. 9E.

Figure 9C:
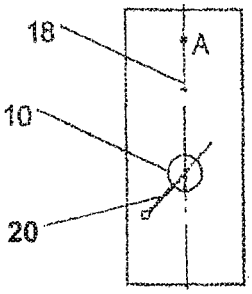
Figure 9D:
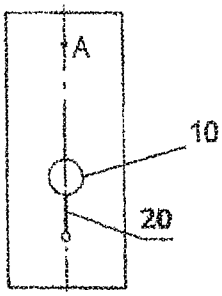

When force P is applied at point A, lobes m and n defined by slot 20, and shown clearly in FIG. 9A, tend to open or bend to the sides thereby broadening the slot 20. The extent to which the lobes m and n bend outwards may be dependent on the magnitude of the force P applied. The bending of lobes m and n is greater when the point A is disposed along axis of symmetry 18 adjacent slot 20 (as in FIGS. 9A and 9B) than when the slot 20 is on the opposing side of opening 10 than point A, as seen in FIG. 9D, and then when the slot 20 is angled relative to the axis of symmetry 18 and to the point A, as illustrated in FIG. 9C.

Reference is now additionally made to FIGS. 10A, 10B, 10C and 10D, which are top view planar illustrations of the element 8 and opening 10 of FIGS. 9A to 9D, having multiple locking components 9 attached thereto according to an embodiment of the invention.

The direction of the slot 20, as described herein with respect to FIGS. 9A to 9E, is particularly significant when the direction in which the force P is applied and/or the magnitude of the force P varies around the opening. In order to overcome the difficulty caused by application of force in multiple directions or magnitudes, multiple locking components 9 may be used, as shown in FIGS. 10A to 10D.

Figure 10A:
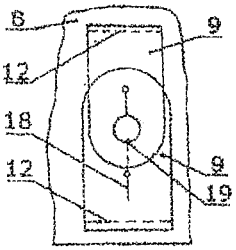
FIGS. 10A, 10B, 10C and 10D are top view planar illustrations of the element and opening of FIGS. 9A to 9D, having multiple locking components attached thereto according to an embodiment of the invention.
Figure 10B:
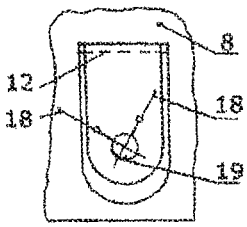
Figure 10C:
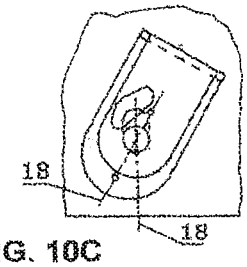

In some embodiments, the bores 11 of the locking components 9 are equivalent in shape to the opening 10, but have their slots 20 arranged at different angles, as illustrated for Example in FIGS. 10A to 10C.

Figure 10D:
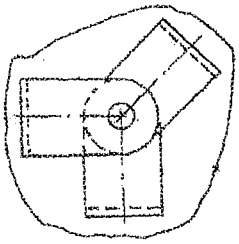

In some embodiments, the multiple locking components 9 are attached to the element 8 at the same attachment region 12, as illustrated in FIGS. 10B and 10C, whereas in other embodiments the locking components 9 have different attachment regions 12, as illustrated in FIGS. 10A and 10D.

In some embodiments, a longitudinal axis of the locking components 9 coincides with a longitudinal axis of element 8, as illustrated in FIGS. 10A and 10B, whereas in other embodiments the longitudinal axes of one or more of the locking components 9 may be angled with respect to the longitudinal axis of element 8, as illustrated in FIGS. 10C and 10D. The angular arrangement of the locking components 9 and/or of their slots 20 preferably takes into consideration the intended point or points 19 at which the neck portion 3 of the anchoring protrusion will engage the opening 10 and bores 11.

Reference is now made to FIGS. 11A and 11B, which illustrate a first embodiment of a multi-layer washer 110 usable as locking component 9 in accordance with the present invention, where FIG. 11A is a top view illustration of the multi-layer washer 110 when spread out, and FIG. 11B is a top view illustration of the multi-layer washer 110 ready to be used.

In some embodiments, particularly in embodiments in which the material of element 8 is sufficiently rigid and therefore does not easily deform, the locking component 9 may be an independent washer, and need not necessarily be attached to element 8. In such embodiments, the locking component may be formed as a multi-layer washer 110, which may in some embodiments be a soft washer.

Such a multi-layer washer 110 may be a planar piece of material, as illustrated in FIG. 11A, and includes a central portion 23 including an opening 23*a*, which may be shaped and sized to imitate or simulate opening 10 in element 8. The multi-layer washer 110 further includes at least one extension lobe 24 including an opening 24*a* which may be shaped and sized to simulate bore 11 of the locking component 9 as described hereinabove.

As seen in FIG. 11B, for use, extension lobe 24 is overlapped with central portion 23, such that openings 23*a* and 24*a* are only partially aligned and define an overlap region 13, as described hereinabove with respect to FIGS. 2A and 2B. For mutual fixation of the central portion 23 and the extension lobe 24, these elements may be fastened to each other, for example, by a threaded seam 25, by thermal welding (in the case of synthetics or plastic), or using any other suitable method.

FIGS. 12A and 12B illustrate a second embodiment of a multi-layer washer 110 usable as a locking component 9, similar to the multi-layer washer of FIGS. 11A and 11B. As seen in FIGS. 12A and 12B, when the diameter (or cross section) of openings 23*a* and 24*a* is substantially equal in size to the diameter 5 of neck portion 3 of anchoring protrusion 100 (FIG. 1), the need for mutual fixation of central portion 23 and extension lobe 24 is eliminated. In this situation, the conditions for formation of overlap region 13 which has a cross section equal in size to the diameter 5 of neck portion 3 occur automatically. As such, the central part 23 and the extension lobe 24 may be formed of a single piece of material which is folded over itself, without fixing a folding point thereof with a seam or other anchoring method, as shown clearly in FIG. 12B.

Reference is now additionally made to FIGS. 13A, 13B, 13C, and 13D, which illustrate a third embodiment of a multi-layer washer 110 usable as a locking component in accordance with the present invention, and to FIGS. 14A and 14B, which are top view planar illustrations of a fourth embodiment and a fifth embodiment of a multi-layer washer 110 usable as a locking component in accordance with the present invention.

As seen in FIGS. 13A to 14B, in some embodiments, the number of extension lobes 24 in a multi-layer washer 110 may be greater than one. Specifically, in FIGS. 13A to 13D the washer includes two lobes 24, and in FIGS. 14A and 14B three such lobes are included. As a result, the central portion 23 and the extension lobes 24 are connected to each other, and may form a locking unit.

Turning specifically to FIGS. 13A to 13D, the multi-layer washer 110 thereof includes central portion 23 and two extension lobes 24. As seen in FIG. 13D, for use, the extension lobes 24 are folded to overlap central portion 23, and may then be fixed by seams 25 or other anchoring methods, as described hereinabove with respect to FIG. 11B. In some embodiments, the openings 23*a* and 24*a* include slots, and are structured such that when the lobes 24 are folded to overlap the central portion 23 each of the slots is oriented in a different direction and the slots do not overlap one another (see for example FIGS. 13A, 14A, and 14B).

As seen from comparison of FIGS. 13B and 13C, the two extension lobes 24 may be folded to overlap central portion 23 in different orientations. Specifically, in FIG. 13B the left side lobe 24' is folded over the central portion 23, and the right-side lobe 24" is folded over the left lobe 24. By contrast, in FIG. 13C, the left side lobe 24' is folded to be beneath the central portion 23, and the right-side lobe 24" is folded to be above the central portion 23, such that both lobes are directly adjacent the central portion.

In some embodiments, the number of extension lobes 24 may be determined based on the properties of material from which the washer is formed, such as stiffness and thickness, and/or on the magnitude of the axial force applied to, or expected to be applied to, the element 8 and washer 110.

When the number of lobes 24 is greater than 2, the opening 23*a* in the central portion 23 may be equal to or greater than the diameter 5 of neck portion 3 of anchoring protrusion 100 (FIG. 1), and may even be equal to or greater than diameter 6 of distal end 2 of anchoring protrusion 100 (FIG. 1), without adversely affecting the locking capabilities of the washer 110. This is due to the fact that the overlap region 13, which is sized to match the diameter of the neck portion 3 of anchoring protrusion 100, is formed by overlapping of openings 24*a* of the lobes 24.

Reference is now made to FIGS. 15A and 15B, which are, respectively, a sectional illustration of a multi-layer washer 110 installed onto an anchoring protrusion 100 according to an embodiment of the present invention and a top view illustration of an element 8 which the multi-layer washer 110 locks into place.

As seen in FIG. 15A, initially, the anchoring protrusion 100 is inserted into opening 10 in element 8, as described hereinabove with respect to FIGS. 3A-3D. Subsequently, the multi-layer washer 110 is mounted onto the anchoring protrusion, by insertion of the anchoring protrusion into openings 23*a* of central portion 23 and 24*a* of extension lobe(s) 24 in any suitable order as described herein. As such, element 8 is disposed between article 102 and washer 110, and is locked therebetween by distal end 2 of the anchoring protrusion 100.

In some embodiments, opening 10 may have multiple diameters, as illustrated in FIG. 15B, and would still be held securely by washer 110. As a result, the element 8 need not be flexible or elastic, as there is no need to stretch the opening 10 thereof to fit the anchoring protrusion through, and element 8 may be made of any suitable material including solid and inelastic materials.

It will be appreciated by people of skill in the art that a multi-layer washer as described herein, which may also be a soft or flexible washer, may be used to fix substantially any type of element 8 onto a suitable connecting link having a neck portion as described herein.

Reference is now made to FIG. 16, which is a sectional illustration of element 8 and multi-layer washer 110 installed onto anchoring protrusion 100 according to another embodiment of the present invention.

As seen in FIG. 16, in some embodiments, the element 8 and the multi-layer washer 110 can be installed onto the anchoring protrusion 100 such that element 8 is disposed between layers of the multi-layer washer. In the illustrated example, the anchoring protrusion is initially inserted into opening 23*a* in central portion 23 of washer 110. Subsequently, anchoring protrusion 100 is inserted into opening 10 in element 8, and finally the extension lobe 24 of washer 110 is mounted onto the anchoring protrusion by passing the anchoring protrusion through opening 24*a* of the lobe. As such, element 8 is securely held between layers of washer 110.

Reference is now made to FIGS. 17A and 17B, which are, respectively, a top view planar illustration and a side view illustration of a multi-layer washer 112 suitable for use with a guitar belt 8 according to an embodiment of the present invention, and to FIGS. 18A and 18B, which are, respectively, a top view planar illustration and a sectional illustration of multi-layer washer 112 of FIGS. 17A and 17B and guitar belt 8 mounted onto an anchoring protrusion button 16 of a guitar according to an embodiment of the present invention.

As seen in FIGS. 17A and 17B, the multi-layer washer 112 includes a central portion 23 having an opening 23*a*, substantially as described herein. In some embodiments, the opening 23*a* is sized such that a diameter thereof is approximately equal to the greatest diameter of button 16 (FIG. 18B), which is the diameter of the distal end of the button. Washer 112 further includes two side extension lobes 24 and a central extension lobe 24'. Each of lobes 24 and 24' includes an opening 24*a*, substantially as described hereinabove. As seen in FIG. 17A, opening 24*a* in central lobe 24' only partially overlaps opening 23*a* in central portion 23, so as to form an overlap region 13 as described hereinabove. Central lobe 24' is fixed to central portion 23 by a seam 25 or by any other connection mechanism so as to ensure the arrangement and partial overlap of the openings 23*a* and 24*a*.

As seen in FIGS. 18A and 18B, for use, the central portion 23 of washer 112 is initially positioned on the button 16 by passing button 16 through opening 23*a*. Next, end portion 8 of the guitar belt is mounted onto the button 16 via a suitable opening 10 thereof. Subsequently, central lobe 24' is positioned on button 16 above belt 8 by passing button 16 through opening 24*a* of central lobe 24'.

The overlap region 13, which is sized to match the diameter of the neck portion of button 16 and is formed once central lobe 24' is mounted onto button 16 above central portion 23, serves to limit the movement of end portion 8 of the guitar belt sideways, or in any other direction. Lastly, side lobes 24 are mounted onto button 16 above central lobe 24' by passing openings 24*a* of side lobes 24 over button 16.

In the illustrated fastening arrangement, side lobes 24 serve to increase the reliability of the axial fixation of end 8 of the guitar belt, as well as to prevent the multilayer washer 112 from pivoting about end 8 of the guitar belt. This is needed to maintain the required mutual position of the slits in the holes of the guitar belt 8 and in the central lobe/petal 24*a*. The multi-layer washer can be attached to the element by the central portion thereof.

In embodiments in which openings 24*a* have an equal diameter to the inner diameter of button 16, or to the smallest diameter thereof, the need for connecting the lobes 24 and/or 24' to central portion 23 by seams 25 or other connection mechanisms is eliminated, and overlap region 13 is formed automatically. In such embodiments, the entire multi-layer washer 112 can be made from a single piece of material with no seams.

Reference is now made to FIGS. 19A, 19B, and 19C, which are side view planar illustrations of various embodiments of anchoring protrusions 100 in accordance with the present invention, and to FIGS. 20A, 20B, and 20C, which are cross sectional illustrations of the anchoring protrusions 100 of FIGS. 19A, 19B, and 19C, respectively, the cross-sectional illustrations taken in a direction perpendicular to longitudinal axes 120 of the anchoring protrusions. In FIG. 19 C the anchoring protrusions is flat.

As seen, the anchoring protrusion 100 as described above with respect to FIG. 1 may have various shapes and cross sections. As seen in FIG. 20A, the anchoring protrusion may be formed by rotation about a longitudinal axis of a planar figure, resulting in a circular cross section perpendicular to the longitudinal axis. Alternately, the cross section may be oval, as shown in FIG. 20B, or may take any other suitable shape. Specifically, the anchoring protrusion of FIGS. 19C and 20C may be particularly suitable for attaching tents to trucks, attaching curtains, and the like.

In embodiments in which the neck portion of the anchoring protrusion has a variable profile, or various diameters, along the longitudinal axis, such as in the embodiments of FIG. 19B, the element and locking component(s) mounted onto the anchoring protrusion may be designed such that the openings thereof correspond to the different diameters of the neck portion. Such design is beneficial in reducing excessive crushing and/or deformation of materials of the element and/or locking component in areas at which the openings thereof contact the anchoring protrusion.

Reference is now made to FIGS. 21A and 21B, which are, respectively, side view and top view planar illustrations of an anchoring protrusion according to the present invention including a multi-part button, and to FIGS. 22A and 22B, which are side view planar illustrations of embodiments of anchoring protrusions according to the present invention including buttons formed of a single unit.

As seen in FIGS. 21A to 22B, the distal end 2 of the anchoring protrusion 100 (FIG. 1) may be a prefabricated structure. In some embodiments, the distal end 2 and the neck portion 3 (FIG. 1) may be formed as separate parts made from different materials. In the embodiment of FIGS. 21A and 21B, the distal end comprises a button 26, here illustrated as a flat button with 4 holes. However, the button may have fewer holes, more holes, or may be a button with shanks. The button 26 is connected to the article 102, by threads 27 extending through the holes in the button and forming the neck portion 3.

In the embodiments of FIGS. 22A and 22B, the anchoring protrusion comprises a single unit including the distal end and the neck portion. For example, FIG. 22A shows a rivet type Jean Tack Button 28 defining the anchoring protrusion and connected to the article 102. As another example, FIG. 22B shows a metal wire having a shaped profile 29 which shaped profile defines the distal end and the neck portion of the anchoring protrusion, such that the neck portion is attached to the article 102.

Reference is now made to FIGS. 23A and 23B, which are, respectively, a sectional illustration and a top view planar illustration of a system for detachably locking an element 8 to an article 102 according to an embodiment of the present invention, to FIG. 23C, which is a top view planar illustration of the system of FIGS. 23A and 23B, including a plurality of locking components 9, and to FIGS. 24A and 24B, which are, respectively, a sectional illustration and a top view planar illustration of a system for detachably locking an element 8 to an article 102 using a multi-layer washer 110 according to an embodiment of the present invention.

As explained hereinabove, in cases in which one wishes to prevent spontaneous opening of the fastener in the article, or the spontaneous detachment of the element from the article, a locking component and/or a multi-layer washer as described herein may be used. For such purposes, the anchoring protrusion 100 may be any suitable type of anchoring protrusion, including buttons, rivets, braces, and the like.

Turning specifically to FIGS. 23A and 23B, in the illustrated embodiment the article 102 has a button 26 attached thereto as the anchoring protrusion, for example using thread as described hereinabove. The element 8 is mounted onto button 26 adjacent article 102, and a locking component 9 is mounted onto button 26 such that it is disposed between a surface of button 26 and element 8. In this arrangement, in order to unfasten the element 8 from the article 102, the locking component 9 must first be removed from the button 26.

Turning to FIG. 23C, the illustrated arrangement is similar to that shown in FIGS. 23A and 23B, with the distinction of the element 8 including a plurality of openings 10 and having a plurality of locking components 9, 9*, and 9 attached thereto. Each of locking components 9, 9*, and 9** has a bore 11 which is partially aligned with a corresponding opening 10, as described herein with respect to FIGS. 2A and 2B. In this arrangement, the element 8 and locking components are mounted onto the button (or other anchoring protrusion), and detached therefrom, sequentially using pairs of corresponding openings 10 and bores 11**.

More specifically, the locking component 9 and 9 from the button, the locking component 9* and the corresponding portion of the element 8 must first be detached from the button. It is particularly important that the last locking component attached to the button, which is also the first locking component detached from the button, be the locking component closest to a free end 17 of element 8, since only the free portion of element 8 may be deformed in the longitudinal direction to release the button from the bore 11 and opening 10, as described hereinabove with respect to FIGS. 3A to 3**D.

In the embodiment of FIGS. 24A and 24B, the locking component 9 has been replaced with a multi-layer washer 110, substantially as described herein with respect to FIGS. 12A to 15B. As seen, the multi-layer washer 110 is disposed on the button 26 such that the element 8 is located between article 102 and washer 110. In this arrangement, the element 8 can only be released from article 102 after removal of washer 110.

It will be appreciated by people of skill in the art that, if for any reason it is desirable to complicate the procedure for removing the element 8 from the article 102, it is possible to increase the number of extension lobes 24 (FIGS. 12A to 15B) of multi-layer washer 110 to four or more such lobes.

Figure 25A:
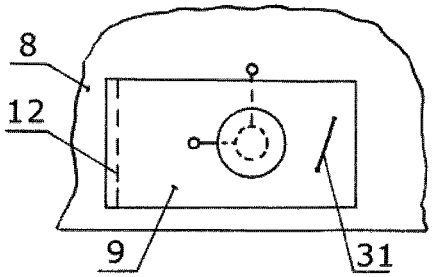
FIGS. 25A and 25B are top view planar illustration of an anchoring system according to the present invention including a permanent connection, where FIG. 25A includes a locking component and FIG. 25B includes a multi-layer washer.
Figure 25B:
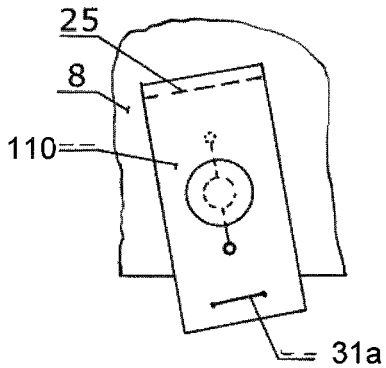

Reference is now made to FIGS. 25A and 25B, which are top view planar illustration of an anchoring system according to the present invention including a permanent connection, where FIG. 25A includes a locking component 9 as described herein with respect to FIGS. 2A and 2B and FIG. 25B includes a multi-layer washer 110 as described herein with respect to FIGS. 12A to 15B.

In some embodiments, it is desirable to create a permanent, irreversible, connection between the element 8 and the article 102. In such embodiments, following installation on anchoring protrusion 100 of the element 8 and locking component 9 and/or multi-layer washer 110, these elements may be fastened together at a fastening point 31, using any suitable fastening method including staples, threads, rivets, glues, thermal welding, and the like.

In embodiments in which a multi-layer washer 110 was used, the various layers of the multi-layer washer may also be fastened together at a fastening point 31*a*, as illustrated in FIG. 25B. The fastening may be accomplished by any suitable fastening method, including staples, threads, rivets, glue, thermal welding for synthetic material and the like.

Reference is now made to FIGS. 26A, 26B, and 26C, which illustrate a system according to the present invention in which the locking component comprises an elastic element or a spring-based element, and to FIGS. 27A, 27B, 27C, and 27D, which illustrate a system according to the present invention in which the locking component comprises a rope.

It will be appreciated by people of skill in the art that in certain instances, the material of element 8 may be sufficiently rigid so as not to easily or sufficiently deform for insertion of the anchoring protrusion into the opening 10. In such embodiments, the locking component 9 can be made of, or include, one or more elastic materials 32. The elastic material(s) 32 enable fixing of element 8 onto the anchoring protrusion 100 without having to deform the element 8, since the elastic material 32 provides for sufficient deformation of the locking component 9. In some embodiments, the elastic material(s) 32 may be replaced by, or may include, a spring element 34 as illustrated clearly in FIG. 26C.

In some embodiments, the locking component 9 may include a rope 35. In some embodiments, the locking component may consist entirely of rope 35, as illustrated in FIGS. 27A and 27C. In other embodiments, the locking component may include rope 35 in addition to other materials, such as elastic material 32, as illustrated for example in FIG. 27B.

In some embodiments, rope 35 may be permanently fastened to element 8, at an attachment region 12, as illustrated in FIG. 27A. In other embodiments, such as that illustrated in FIG. 27C, the rope 35 may be removably attached to element 10. In some such embodiments, it is also possible to manually tension the rope 35 by forming a knot or other connecting assembly 36 between ends of rope 35 as illustrated in FIG. 27C, or by using a connecting clip 37 or other suitable tensioning device, as illustrated in FIG. 27D.

Figure 28A:
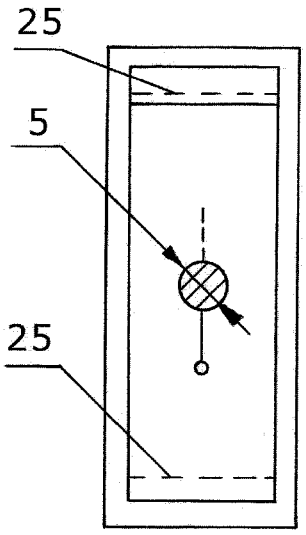
FIGS. 28A and 28B are, respectively, a top view planar illustration and a sectional illustration of a multi-layer washer having an anchoring protrusion fastened thereto according to an embodiment of the invention.
Figure 28B:
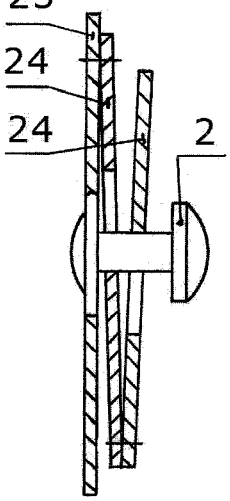
Figure 29A:
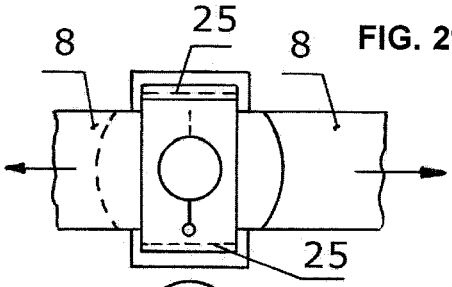
FIGS. 29A and 29B are, respectively, a top view planar illustration and a sectional illustration of a multi-layer washer having an anchoring protrusion fastened thereto used for anchoring two elements according to an embodiment of the invention.
Figure 29B:
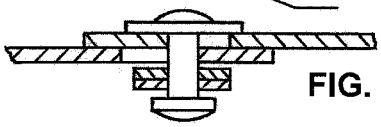
Figure 30A:
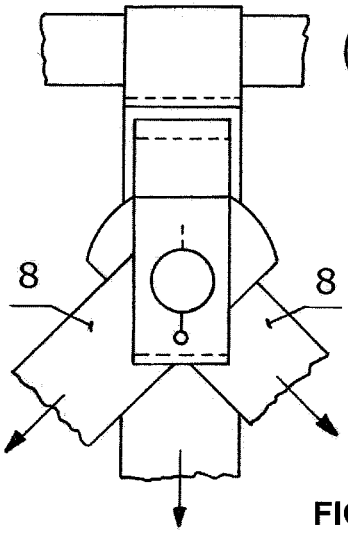
FIGS. 30A and 30B are, respectively, a top view planar illustration and a sectional illustration of a multi-layer washer having an anchoring protrusion fastened thereto used for anchoring multiple elements according to an embodiment of the invention.
Figure 30B:
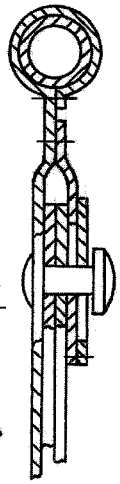

Reference is now made to FIGS. 28A and 28B, which are, respectively, a top view planar illustration and a sectional illustration of a multi-layer washer having an anchoring protrusion fastened thereto according to an embodiment of the invention, to FIGS. 29A and 29B, which are, respectively, a top view planar illustration and a sectional illustration of a multi-layer washer having an anchoring protrusion fastened thereto used for anchoring two elements according to an embodiment of the invention, and to FIGS. 30A and 30B, which are, respectively, a top view planar illustration and a sectional illustration of a multi-layer washer having an anchoring protrusion fastened thereto used for anchoring multiple elements according to an embodiment of the invention.

In some embodiments, when using a multi-layer washer 110 as described hereinabove with respect to FIGS. 12A to 15B, the shaft 1 of the anchoring protrusion may be fastened to the central portion 23 of the multilayer washer in place of an opening, as illustrated in FIGS. 28A and 28B, to form a multi-layer washer anchoring device 130. As such, the central portion 23 of multi-layer washer 110 may function as the article 102 to which the element 8 will be attached.

In other embodiments, the multi-layer washer anchoring device 130 may be used as a stand-alone device to which holding multiple elements 8 may be attached, as illustrated in FIGS. 29A and 29B, or may be attached to a portion of the article 102, for example as illustrated in FIGS. 30A and 30B.

In some embodiments, when the multi-layer washer and shaft are used to hold two or more elements 8, the elements may be arranged along a line, as illustrated in FIGS. 29A and 29B, or may angled with respect to one another, as illustrated in FIGS. 30A and 30B. Force may be applied to the elements 8 in the respective directions, as illustrated in FIGS. 29A and 30A.

In use, the element(s) 8 are initially mounted onto the anchoring protrusion adjacent the central portion 23 of the multi-layer washer. Subsequently, the extension lobes 24 are placed above the element(s) 8 by passing the anchoring protrusion through openings in lobes 24, as described hereinabove. In this manner, a locking unit is formed, as illustrated in FIGS. 29A to 30B.

In some embodiments, the multi-layer washer anchoring device 130 may be attached to another article, or have additional elements mounted thereon, as needed for the specific application.

While the disclosed technology has been taught with specific reference to the above embodiments, a person having ordinary skill in the art will recognize that changes can be made in form and detail without departing from the spirit and the scope of the disclosed technology. The described embodiments are to be considered in all respects only as illustrative and not restrictive. All changes that come within the meaning and range of equivalency of the claims are to be embraced within their scope. Combinations of any of the methods and apparatuses described hereinabove are also contemplated and within the scope of the invention.

The invention claimed is:

1. An assembly for axial fixation of at least one element having an opening formed therein to an article, the assembly comprising:

an anchoring protrusion attached to said article, the anchoring protrusion including a distal end distal to the article and a neck portion disposed between the article and the distal end, said neck portion having a first diameter and said distal end having a second diameter, said second diameter being greater than said first diameter;

at least one locking component having at least one bore disposed therein, said locking component having at least a portion which is at least one of flexible and elastic, wherein said anchoring protrusion extends through said opening in said at least one element and through at least one said bore of said at least one locking component, such that said opening and said at least one said bore are disposed about said neck portion of said anchoring protrusion, wherein at least a portion of said locking component is disposed between said at least one element and a surface of said distal end of said anchoring protrusion, and wherein an overlap region between said opening of said at least one element and said at least one bore of said at least one locking component, is substantially equal to said first diameter, such that said at least one element and said at least a portion of said locking component form a locking unit.

2. The assembly of claim 1, wherein said at least one element includes a solid material, reinforcing at least a portion of a perimeter of said opening in said element.

3. The assembly of claim 1, wherein said at least one locking component is fixedly attached to said element.

4. The assembly of claim 1, wherein said at least one element and said locking component are integrally formed from a single piece of material.

5. The assembly of claim 1, wherein said locking component comprises a multi-layer washer separate and independent from said element, said multi-layer washer including:

a central portion including a first bore; and at least one extension lobe including at least one second bore, wherein said anchoring protrusion extends through said first bore of said central portion and through said at least one second bore in said at least one extension lobe, such that along a longitudinal axis of said anchoring protrusion, said central portion is disposed closer to the article than said at least one extension lobe.

6. The assembly of claim 5, wherein said central portion is disposed between said article and said element, said element is disposed between said central portion and said at least one extension lobe, and said at least one lobe is disposed between said element and said distal end of said anchoring protrusion.

7. The assembly of claim 1, wherein said anchoring protrusion comprises a device forming said distal end, and said neck portion comprises an attachment mechanism connecting said device to said article.

8. The assembly of claim 1, wherein said distal end and said neck portion of said anchoring protrusion are integrally formed.

9. The assembly of claim 1, wherein said locking component includes at least one elastic or spring-based portion which extends around at least a portion of said anchoring protrusion.

* * * * *